United States Patent [19]

Ashworth

[11] Patent Number: 4,607,412

[45] Date of Patent: Aug. 26, 1986

[54] REVERSIBLE BUFFING PAD AND METHOD OF MANUFACTURE

[76] Inventor: Lewis A. Ashworth, 2633 N. Canal, Orange, Calif. 92665

[21] Appl. No.: 715,337

[22] Filed: Mar. 25, 1985

[51] Int. Cl.[4] ..... B24D 13/14; B24D 13/20

[52] U.S. Cl. ..... 15/230.18; 15/230; 300/21

[58] Field of Search ..... 15/230, 230.12, 230.15, 15/230.17, 230.18, 230.19, 97 R; 300/21

[56] References Cited

U.S. PATENT DOCUMENTS

| | | | |
|---|---|---|---|
| 3,342,533 | 9/1967 | Engel et al. | 15/230.18 |
| 3,413,674 | 12/1968 | Reid | 15/230.12 |
| 3,717,894 | 2/1973 | Wakefield | 15/230.15 |
| 3,990,124 | 11/1976 | MacKay, Jr. et al. | 15/230.12 |
| 4,149,294 | 4/1979 | MacKay, Jr. et al. | 15/230.18 |
| 4,403,367 | 9/1983 | Brown et al. | 15/230.12 |

*Primary Examiner*—Edward L. Roberts

[57] ABSTRACT

A buffing pad includes hub including screw threads therein for releasably attaching the hub to a drive shaft from either side of the hub. A fusible center disk is attached to the hub and a pair of buffing pads are provided with each having a plurality of yarn tufts protruding from a first side thereof and a plurality of yarn stitches which are exposed in a second side thereof. Additional fusible material is provided for securing the stitches in the buffing pads, coaxially securing the center disk between the second sides of the buffing disks and securing the second sides of the buffing disk together to form a buffing pad, with the two tufted first sides of the buffing disk facing outwardly from one another. During manufacture of the buffing pad the center disk is heat-formed into a tapered configuration which decreases in thickness from a position adjacent a coaxial hold therein to an outer edge thereof. This tapering enables the pad to be flexible at outer edges thereof for conforming with curved surfaces, yet at the same time maintaining a firm support toward the center thereof for application of pressure during buffing.

18 Claims, 4 Drawing Figures

74
72
32
28
24
86
42
52
52
12
68
56
56
60
16
64
64
60
14
64
10
18
60
52
52
44
40
40
86
30
40
26
34

REVERSIBLE BUFFING PAD AND METHOD OF MANUFACTURE

The present invention generally relates to buffing pads for use in polishing automobiles and the like and is more particularly directed to a "dual-sided" buffing pad, which is easily attached, removed, reversed and reattached to the drive shaft of a buffing motor.

Traditionally buffing pads for use in high speed polishing of automobiles and the like have been one-sided pads. That is, the nap, consisting of a plurality of yarn tufts, is disposed on one side of a backing plate and attached to a motor driven drive shaft with the backing plate facing the drive motor and the exposed nap available for buffing as the buffing pad is spun by the drive motor.

High speed buffing may utilize buffing pads rotated from between 1750–3000 RPMs. Since the buffing pads may be 8 inches or more in diameter, a great amount of torque is applied to the pad as the buffer motor turns the buffing pad up to speed. In addition, considerable forces are exerted on the pad during its contact with a surface during buffing.

Consequently, mounting of the pad to the drive shaft presents difficult problems.

In the past, buffing pads have been mounted to a drive shaft by means of a face plate, which bears against the front, or nap, side of the buffing pad, and is engaged by a bolt passing through the face plate and the buffing plate and into mating threads on the drive shaft, or a connector to the drive shaft. Utilizing either right or left hand threads, depending upon the rotation of the pad, the bolt is continually tightened as the buffing pad is rotated forcing the face plate against the pad and holding it to the drive shaft.

While simple in nature, this approach in mounting a buffing pad has a significant number of disadvantages. First, the face plate itself usually covers a significant portion of the front of the buffing pad, thereby reducing the useable buffing area of the buffing pad.

In addition, since the face plate is not typically a soft buffing material, contact with a surface will cause scratching thereof, hence, the buffing process must be carefully controlled to avoid damage to the surface.

Finally, because of the large size of the buffing motor and the buffing pad, it is very difficult to change buffing pads since alignment between the buffing pad, the drive shaft, the face plate, and the bolt extending therethrough is necessary, all at the same time. In practice, this has proved to be awkward, difficult to accomplish, time-consuming and frustrating to an operator.

There is a need for a buffing pad, which may be mounted to a drive motor, without the need of a face-type plate, which can be quickly changed as the active surface of the buffing pad becomes clogged.

For example, an average buffing pad used in a commercial environment may have to be changed several times for each automobile polished, depending on many factors, including the condition of the automobile finish.

The present invention includes a two-sided buffing pad and a method of its manufacture which overcomes all of the prior art difficulties in mounting the pad to a power buffer motor, and at the same time being more economical than a single-sided buffing pad because of the reversibility and availability of two buffing surfaces on each pad.

Further, because the buffing pad of the present invention does not include any protruding face plate to hold the buffing pad to a drive shaft, the entire exposed surface of the buffing pad may be utilized during the buffing process, hence, making the pad easier to use, while at the same time eliminating the possibility of damage to the surface being buffed.

In addition, because the face plate is eliminated and the total face of the buffing pad is available for buffing, buffing time may be reduced for any given surface.

As will be hereinafter described, the buffing pad for the present invention may be removed and/or reversed in a simple manner without the alignment of a great number of parts, as is necessary in prior art buffers.

SUMMARY OF THE INVENTION

A buffing pad, in accordance with the present invention, includes a hub having means for releasably attaching the hub to a drive shaft from either of the two sides of the hub.

A center disk is provided, as well as means for mounting the hub coaxially with the heat processable center disk. A pair of buffing disks are provided with each having a plurality of yarn tufts protruding from a first side thereof and a plurality of yarn stitches exposed on a second side thereof.

The plurality of yarn tufts are of sufficient number and density to provide a buffing nap on the first side of each buffing disk. Means are provided for securing the stitches in the buffing disks, coaxially securing the center disk between the second sides of the buffing disks and securing the second sides of the buffing disk together to form a buffing pad, with the two tufted first sides of the buffing disk facing outwardly from one another.

While the buffing pad may be coupled directly to a drive shaft if the latter is properly adapted, the present invention also may include a connector having a male thread on one end thereof, and having another end adapted for attachment to a motor-driven drive shaft. In this instance, the hub has female thread means therein for releasably attaching to the connector from either of two sides of the hub.

More particularly, the means for securing the stitches in the buffing disks, coaxially securing the center disk between the second sides of the buffing disk and securing the second sides of the buffing disk together, includes a fusible material means for combining with said heat processable center disk.

In order to insure that the starting torque and torque applied to the hub during buffing does not tear it loose from the center disk and the buffing disks, a pair of washers may be provided, one on each side of the center disk and attached to one another through the center disk. In addition, the center disk may include means defining a plurality of holes therein for the fusible material to flow thereinto upon the application of heat. In this manner, the center of the disk becomes a unitary mass which binds the two buffing disks together.

Additionally, the center disk comprises fusible material means for enabling the center disk to be heat-formed during assembly of the buffing pad, and, as a result of heat and pressure, decreases in thickness from a position adjacent a coaxial hole therein to an outer edge thereof.

This feathering, or tapering of the center support disk in the pad is important, because the pad must be flexible for conforming with curved surfaces toward the outer edges, yet at the same time maintaining a firm support toward the center thereof for application of pressure during buffing.

A method of manufacturing the buffing pad, in accordance with the present invention, comprises the steps of sewing two buffing disks with yarn to provide a plurality of yarn tufts protruding from the first side thereof and a plurality of yarn stitches exposed on a second side thereof, mounting a hub to a center disk, securing said stitches in the buffing disk by means of a fusible material, and fusing the second sides of the buffing disk together with the hub and center disk therebetween to form a buffing disk having two tufted front sides of the buffing disk facing outwardly from one another. In this manner, a two-sided, or faced, buffing pad is produced.

It is important that during the fusing of the second sides of the buffing disk together with the hub and the center disk therebetween, that the center disk is heat-formed with the thickness of the center disk decreasing from the point adjacent a coaxial hole therein to an outer edge thereof.

BRIEF DESCRIPTION OF THE DRAWINGS

The advantages and features of the present invention will appear from the following description when considered in conjunction with the accompanying drawings, in which.

DETAILED DESCRIPTION

Figure 1:
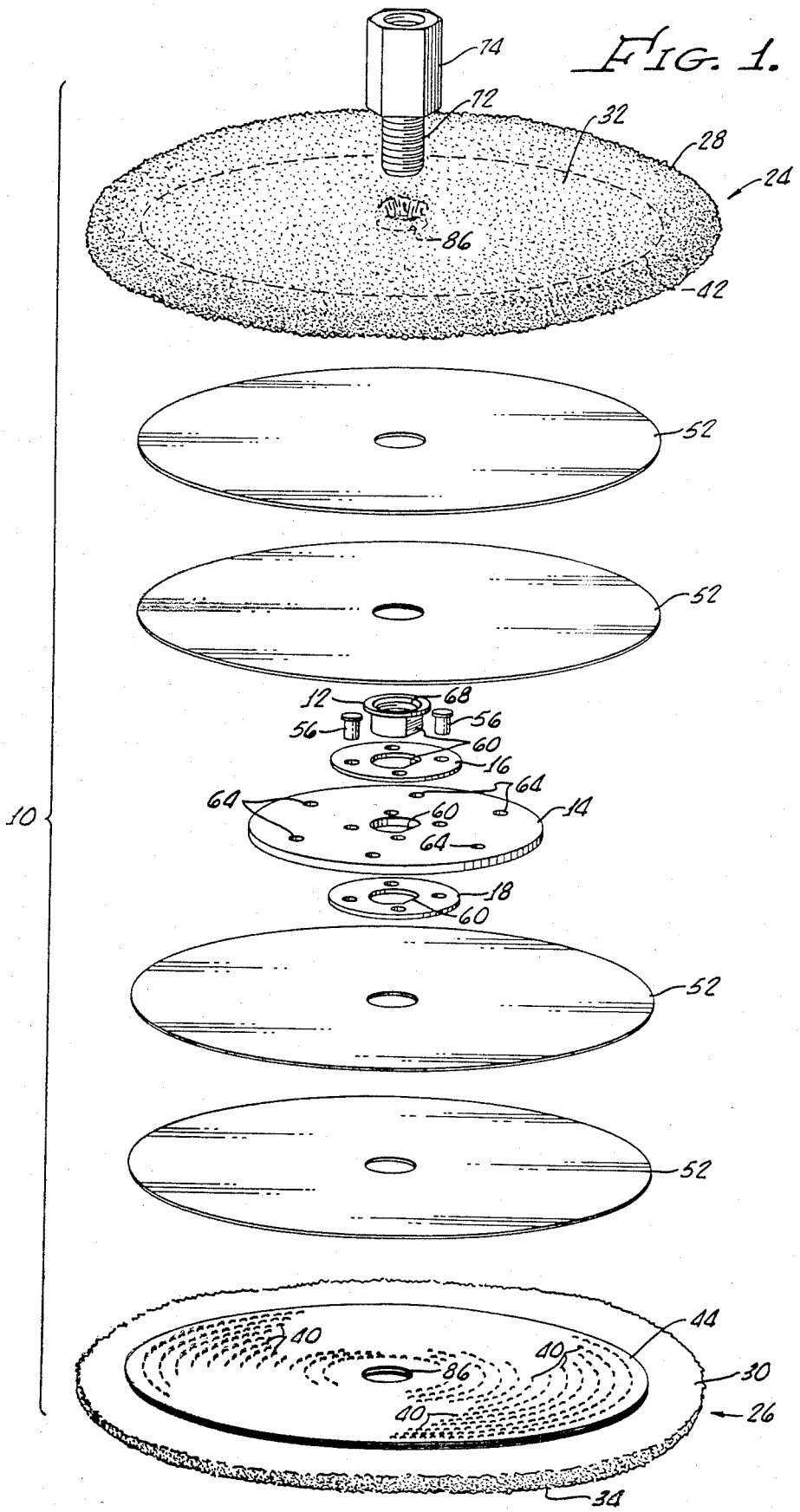
FIG. 1 is an exploded perspective view of a buffing pad, made in accordance with the present invention.

Turning to FIG. 1, there is shown a buffing pad 10, in accordance with the present invention, generally showing a hub 12, a center disk 14 and washers 16, 18, which, in part, provide a means for mounting the hub 12 coaxially with the center disk 14.

The buffing pad 10 also generally includes a pair of buffing disks 24, 26, each having a plurality of yarn tufts 28, 30 protruding from a first side 32, 34 thereof and a plurality of yarn stitches 40 exposed on a second side 42, 44 of the disks 24, 26.

Figure 2:
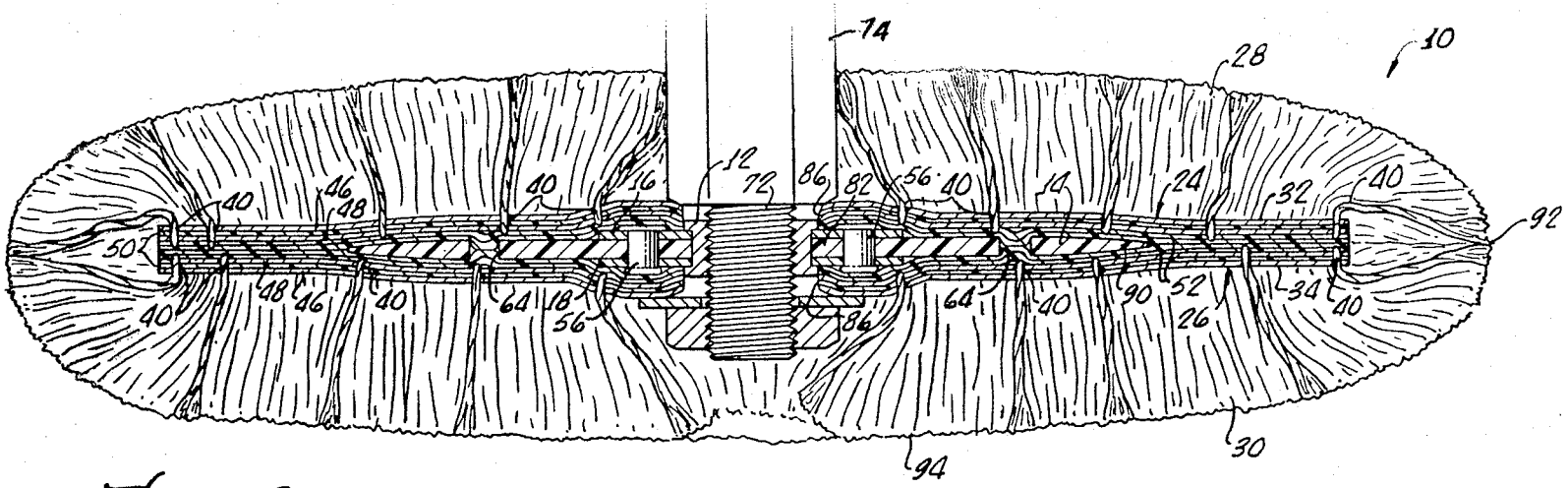
FIG. 2 is a cross-sectional view of the buffing pad, shown in FIG. 1, generally showing a center disk having a thickness which decreases from a position adjacent a coaxial hole therein to an outer edge thereof.

As shown in FIG. 2, the disks 24, 26 may be formed from two circular pieces of 10 ounce denim 46, 48 having a diameter of about 10 inches or more, which are fused together with a suitable material, such as polyethylene 50.

When the disks 24, 26 are laminated, as will hereinafter be described, the denim 46, 48 and the fusible material 50 provide a sufficient flexible buffing pad at the periphery thereof to enable the pad to curve into contoured portions of an automobile, to provide for effective polishing thereon, while at the same time retaining sufficient rigidity to spring back to a generally planer configuration for flat polishing.

Layers 52 of polyethylene material provide means for securing the stitches 40 in the buffing disks 24, 26. Being a fusible material, the polyethylene layers 52 when heated, penetrate into the second sides 42, 46 of the disks 24, 26, thereby securing the stitches 40 as well as the yarn tufts 28, 30 in the disks 24, 26.

In addition, as will be hereinafter described in greater detail, the polyethylene layers 52 also provide a means for securing the disk second sides 42, 44 together, as well as securing the center disk 14 between the disks second sides 42, 44.

The hub 12 is coaxially mounted with the center disk 14 by means of the washers 54, which may be case hardened metal, disposed on each side of the center disk 14 and attached to one another and the center disk 14 by means of rivets 56, or the like.

To further inhibit a breaking away of the hub from the center disk and consequently the buffing disks 24, 26, a flat indexed area 60 may be formed into the hub 12 washers 16, 18, and center disk 14.

To further enhance the coupling of the center disk and hub to the buffing disks 24, 26, holes 64 may be provided in the center disk 14 to enable the fusible polyethylene material 52 to flow thereinto during assembly of the buffing pad 10.

Female screw threads 68 are provided in the hub 12 for engagement with threads 72 disposed on a connector 74, which is adapted for attachment to a drive motor shaft, not shown.

It should be appreciated that the motor shaft itself may be fitted with screw threads for engagement with the hub 12, thus eliminating the need for the conector 74.

It is readily apparent that the connector 74, or drive shaft, can quickly engage the buffing pad hub 12.

While a great deal of manipulating must be done with prior art devices having a face place and a screw therethrough to hold the pad to a drive shaft as hereinbefore described, the pad of the present invention can be negaged by the connector or drive shaft without any handling if the pad is placed on a surface and the screw threads 68 and the hub 12 engaged by the connectors screw thread 72, while the connector 74 is rotated, thus causing the hub 12 to screw onto the connector 74.

As can be seen from FIG. 2, the center disk of the present invention has a thickness which decreases from a position 82 adjacent the coaxial hole 86 to an outer edge 90.

As shown in FIG. 1 the disk is originally of uniform thickness, however, during the method of manufacture of the present invention, heating and pressing of the disk, as will be hereinafter described, causes the center disk 14 to be formed into the generally tapered configuration shown in the cross-section of FIG. 2.

As hereinbefore pointed out, it is important that the buffing pad have flexibility at its outer edge and decreased flexibility towards the center, to enable proper buffing on curved as well as flat surfaces.

Hence, it is preferred that the center disk have a tapered cross-section, as shown in FIG. 2, to enable a general increase in stiffness from an outer edge 92 of the pad to the center of the pad 94.

In the method of manufacturing a buffing pad, in accordance with the present invention, the two circular pieces 46, 48 of 10 ounce denim are fused together by heating with a 7 mil piece of polyethylene therebetween to form the buffing disks 24, 26.

Thereafter, the disks 24, 26 are sewed with a yarn to provide a plurality of yarn tufts 28 protruding from the disk first sides 32, 34. Extending through the disks 24, 26 the yarn is formed into a plurality of stitches 40 exposed on the disk second sides 42, 44.

The hub 12 is mounted to the center disk 14 by means of washers 16, 18 and rivets 56, as hereinbefore described.

Figure 3:
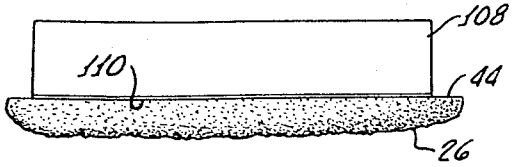
FIG. 3 is a representation of a step in the method of the present invention showing the securing of stitches in a buffing disk utilizing a fusible material and a heating element; and, FIG. 4 is a representation of a step of the method of the present invention showing the fusing of two buffing disks together to form a buffing pad.

As illustrated in FIG. 3, a heating element 108, which may have a teflon face 110 thereon to prevent sticking, is utilized to secure the stitches 40 in the disks 24, 26 by fusing polyethylene material 52 thereinto, the polyethylene material flowing around the stitches and into the denim surface, leaving a tacky second surface 42, 44.

Figure 4:
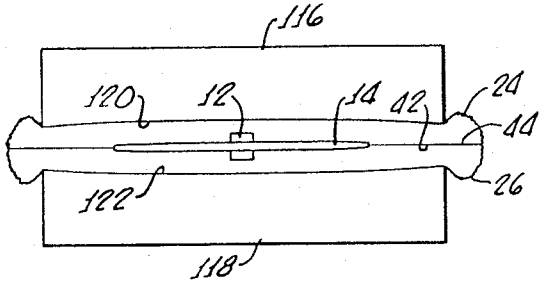

Quickly thereafter, as illustrated in FIG. 4, two disks 24, 26 having a tacky second surface 42, 44 after heating by the element 108 are placed together with the center disk 14 and hub 12 between two heated plates 116, 118 therebetween.

Pressure and heat are then applied under conditions to enable the polyetheylene material 52 to flow into the center disk holes 64.

The heated plates may include contoured faces 120, 122 in order to form the center disk 14 into the tapered configuration, as best shown in FIG. 2.

Although there has hereinabove been described a specific arrangement of the buffing pad and its method of manufacture, in accordance with the present invention, for the purpose of illustrating the manner in which the invention may be used to advantage, it will be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. A buffing pad comprising:

a hub having means for releasably attaching said hub to a drive shaft, said means enabling attachment to said drive shaft from either of two sides of said hub;

a heat processable center disk;

means for mounting said hub coaxially with said heat processable center disk;

a pair of buffing disks each having a plurality of yarn tufts protruding from a first side thereof and a plurality of yarn stitches exposed on a second side thereof, said plurality of yarn tufts being of sufficient number and density to provide a buffing nap on the first side of each buffing disk; and, means for securing said stitches in said buffing disks, coaxially securing said center disk between the second sides of the buffing disks, and securing the second sides of the buffing disk together to form a buffing pad with the two tufted first sides of the buffing disks facing outwardly from one another, said last mentioned means including fusible material means for combining with said heat processable center disk.

2. The buffing pad according to claim 1 wherein said heat processable center disk comprises fusible material means for enabling the heat processable center disk to be heat formed during assembly of the buffing pad said heat processable center disk having a thickness which decreases from a position adjacent a coaxial hole therein to an outer edge thereof.

3. A buffing pad comprising:

a hub having means for releasably attaching said hub to a drive shaft, said means enabling attachment to said drive shaft from either of two sides of said hub;

a center disk, said disk including means defining a plurality of holes therein for a fusible material to flow thereinto upon the application of heat thereto;

means for mounting said hub coaxially with said center disk;

a pair of buffing disks each having a plurality of yarn tufts protruding from a first side thereof and a plurality of yarn stitches exposed on a second side thereof, said plurality of yarn tufts being of sufficient number and density to provide a buffing nap on the first side of each buffing disk; and, means for securing said stitches in said buffing disks, coaxially securing said center disk between the second sides of the buffing disks, and securing the second sides of the buffing disk together to form a buffing pad with the two tufted first sides of the buffing disks facing outwardly from one another, said last mentioned means including a fusible material.

4. The buffing pad according to claim 3 wherein said means for releasably attaching said hub to a drive shaft includes coaxial screw threads.

5. The buffing pad according to claim 4 wherein said means for coaxially mounting the hub to the center disk includes a pair of washers, one on each side of said center disk and attached to one another through said center disk.

6. The buffing pad according to claim 5 wherein said center disk decreases in thickness from a position adjacent a coaxial hole therein to an outer edge thereof.

7. The buffing pad according to claim 6 wherein said pair of buffing disks each comprise two fabric disks laminated by a fusible material.

8. Buffing pad apparatus comprising:

a connector having a male thread on one end thereof and having another end adapted for attachment to a motor driven drive shaft;

a hub having female thread means therein for releasably attaching said hub connector, said female thread means enabling attachment to said connector either of two sides of said hub;

a heat processable center disk;

means for mounting said hub coaxially with said heat processable center disk;

a pair of buffing disks each having a plurality of yarn tufts protruding from a first side thereof and a plurality of yarn stitches exposed on a second side thereof, said plurality of yarn tufts being of sufficient number and density to provide a buffing nap on the first side of each buffing disk; and, means for securing said stitches in said buffing disks, coaxially securing said center disk between the second sides of the buffing disks, and securing the second sides of the buffing disk together to form a buffing pad with the two tufted first sides of the buffing disks facing outwardly from one another, said last mentioned means including fusible material means for combining with said heat processable center disk.

9. The buffing pad apparatus according to claim 8 wherein said heat processable center disk comprises fusible material means for enabling the heat processable center disk to be heat formed during assembly of the buffing pad, said heat processable center disk having a thickness which decreases from a position adjacent a coaxial hole therein to an outer edge thereof.

10. A buffing pad apparatus comprising:

a connector having a male thread on one end thereof and having another end adapted for attachment to a motor driven drive shaft;

a hub having female thread means therein for releasably attaching said hub connector, said female thread means enabling attachment to said connector either of two sides of said hub;

a center disk, said disk including means defining a plurality of holes therein for a fusible material to flow into upon the application of heat thereto;

means for mounting said hub coaxially with said center disk;

a pair of buffing disks each having a plurality of yarn tufts protruding from a first side thereof and a plurality of yarn stitches exposed on a second side thereof, said plurality of yarn tufts being of sufficient number and density to provide a buffing nap on the first side of each buffing disk; and, means for securing said stitches in said buffing disks, coaxially securing said center disk between the second sides of the buffing disks, and securing the second sides of the buffing disk together to form a buffing pad with the two tufted first sides of the buffing disks facing outwardly from one another said last mentioned means including a fusible material.

11. The buffing pad apparatus according to claim 10 wherein said means for coaxially mounting the hub to the center disk includes a pair of washers, one on each side of said center disks and attached to one another through said center disk.

12. The buffing pad apparatus according to claim 11 wherein said center disk decreases in thickness from a position adjacent a coaxial hole therein to an outer edge thereof.

13. The buffing pad apparatus according to claim 12 wherein said pair of buffing disks each comprise two fabric disks laminated by a fusible material.

14. A method of manufacturing a buffing pad comprising the steps of:

sewing two buffing disks with a yarn to provide a plurality of yarn tufts protruding from a first side thereof and a plurality of yarn stitches exposed on a second side thereof;

mounting a hub to a center disk;

securing said stitches in the buffing disks by means of a fusible materials, and fusing the second sides of the buffing disk together with the hub and center disk therebetween to form a buffing disk having the two tufted first sides of the buffing disks facing outwardly from one another.

15. The method of manufacturing a buffing pad according to claim 14 wherein said center disk includes means defining a plurality of holes therein for said fusible material to flow thereinto upon the application of heat thereto.

16. The method of manufacturing a buffing pad according to claim 15 wherein said hub is mounted to the center disk by means of a pair of washers, one on each side of said center disk and attached to one another through said center disk.

17. The method of manufacturing a buffing pad according to claim 16 wherein during fusing the second sides of the buffing disk together with the hub and center disk therebetween causes the center disk to be heat formed with the thickness of the center disk decreasing from a position adjacent a coaxial hole therein to an outer edge thereof.

18. The method of manufacturing a buffing pad according to claim 17 further comprises the steps of forming the two buffing disks by laminating two fabric disks together with a fusible material.

* * * * *

UNITED STATES PATENT AND TRADEMARK OFFICE

CERTIFICATE OF CORRECTION

PATENT NO. : 4,607,412

DATED : August 26, 1986

INVENTOR(S) : Lewis A. Ashworth

It is certified that error appears in the above-identified patent and that said Letters Patent is hereby corrected as shown below:

On the title page Insert:

-- Attorney, Agent Or Firm: Walter A. Hackler --.

Signed and Sealed this

Twenty-fifth Day of November, 1986

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,607,412

DATED : August 26, 1986

INVENTOR(S) : Lewis A. Ashworth

It is certified that error appears in the above-identified patent and that said Letters Patent are hereby corrected as shown below:

Add to Title Page the following:

ASSIGNEE: BAF Industries
Santa Ana, California

Signed and Sealed this

Seventeenth Day of February, 1987

*Attest:*

DONALD J. QUIGG

*Attesting Officer*

*Commissioner of Patents and Trademarks*